US005434348A

United States Patent [19]

Matsuda et al.

[11] Patent Number: 5,434,348

[45] Date of Patent: Jul. 18, 1995

[54] ELECTRONIC KEYBOARD INSTRUMENT

[75] Inventors: Eiji Matsuda; Tetsuya Hirano, both of Shizuoka, Japan

[73] Assignee: Kabushiki Kaisha Kawai Gakki Seisakusho, Shizuoka, Japan

[21] Appl. No.: 87,369

[22] Filed: Jul. 8, 1993

[30] Foreign Application Priority Data

Jul. 9, 1992 [JP] Japan ..... 4-204322

[51] Int. Cl.[6] ..... G10H 1/057; G10H 1/18; G10H 1/46

[52] U.S. Cl. ..... 84/615; 84/626; 84/627; 84/633

[58] Field of Search ..... 84/604, 615, 622, 626, 84/627, 633, 653, 658, 659, 662, 663, 665, 701, 702, 703, 718, 721

[56] References Cited

U.S. PATENT DOCUMENTS

| | | | |
|---|---|---|---|
| 5,097,741 | 3/1992 | Kikumoto | 84/665 |
| 5,136,916 | 8/1992 | Shibukawa | 84/663 |
| 5,179,242 | 1/1993 | Usa | 84/658 |
| 5,241,130 | 8/1993 | Shibukawa | 84/659 |
| 5,292,997 | 3/1994 | Kato et al. | 84/627 |

*Primary Examiner*—Stanley J. Witkowski
*Attorney, Agent, or Firm*—Evenson, McKeown, Edwards & Lenahan

[57] ABSTRACT

A electronic keyboard instrument for producing an artificial sound, including a plurality of keys; waveform-forming structure for generating a signal indicative of a waveform of an artificial sound corresponding to one of the keys, when the one of the keys is depressed; at least one operating element; detecting structure for detecting whether or not the at least one operating element is being operated; and waveform-modifying structure for modifying the signal indicative of the wave form depending on results of detection by the detecting structure, the waveform-modifying structure including envelope-determining structure for determining an envelope of the wave form of the artificial sound, and envelope-modifying structure for outputting a modification value used in changing an output from the envelope-determining structure depending on results of detection by the detecting structure.

16 Claims, 5 Drawing Sheets

ELECTRONIC KEYBOARD INSTRUMENT

BACKGROUND OF THE INVENTION

1. Field of the Invention

This invention relates to an electronic keyboard instrument, such as a synthesizer, an electronic piano, an electronic organ and a single keyboard, which is capable of producing artificial sounds, and more particularly to an electronic keyboard instrument which is adapted to impart variation to artificial sounds produced, depending on whether or not an operating element thereof is operated.

2. Prior Art

Conventionally, an electronic keyboard instrument, e.g. an electronic piano, is known, which has a damper pedal for imparting variation to artificial sounds produced. Such an electronic piano is adapted to change duration of a tone lingering after a player has released a key thereof, depending on whether or not the player depressed the key while stepping on the damper pedal at the same time.

However, such a conventionally, electronic keyboard instrument suffers from the following inconveniences:

Whether the damper pedal is stepped on or not does not result in variation of the tone per se of an artificial sound produced by an electronic piano and the like, but merely in a change or changes of either or both of loudness and duration of a lingering tone, with the waveform of the artificial sound merely increasing in amplitude and/or length as a whole, i.e. with the waveform per se undergoing a slight change. Therefore, a player cannot make his or her performance very much the more colorful by operating the damper pedal.

Further, the duration of the lingering tone of the artificial sound cannot be freely changed by a player.

SUMMARY OF THE INVENTION

It is an object of the invention to provide an electronic keyboard instrument which is capable of varying the waveform per se of an artificial sound produced, depending on whether or not an operating element is being operated when a key thereof is depressed, thereby allowing a player to give a more colorful performance.

To attain the object, the present invention provides an electronic keyboard instrument for producing an artificial sound, comprising:

a plurality of keys;

waveform-forming means for generating a signal indicative of a waveform of an artificial sound corresponding to one of tile keys, when the one of tile keys is depressed;

at least one operating element;

detecting means for detecting whether or not the at least one operating element is/are being operated; and waveform-correcting means for correcting the signal indicative of the waveform depending on results of detection by the detecting means.

According to the electronic keyboard instrument of the invention, the detecting means detects whether or not the at least one operating element is/are being operated, and the waveform-correcting means corrects the waveform of the artificial sound to be produced, depending on the results of detection by the detecting means. Therefore, the artificial sound produced by the electronic keyboard instrument is varied in its tone and loudness, depending on whether or not the at least one operating element is/are operated, which enables a player to make his performance more colorful.

More specifically, the waveform-correcting means includes envelope-determining means for determining an envelope of the waveform of the artificial sound, and envelope-modifying means for outputting a correction value used in changing an output from the envelope-determining means depending on results of detection by the detecting means.

Preferably, the envelope-modifying means includes at least one correction value, and selecting means for selecting one of the at least one correction value depending on the results of detection by the detecting means.

More preferably, the envelope-modifying means changes the maximum amplitude of the waveform of the artificial sound which is reached at a rise time of the waveform and determined according to the key depression speed.

According to this preferred embodiment of the invention, the artificial sound can be produced such that it has the attack level proportional to the key depression speed, and hence the tone of the artificial sound can be made more colorful.

For example, the at least one operating element is formed by a single operating element, with the at least one correction value consisting of two correction values, and the selecting means selects one of the two correction values depending on the results of detection by the detecting means.

Alternatively, the at least one operating element consists of a plurality of operating elements, and the waveform-correcting means includes determining means for determining which of the plurality of operating elements is being operated based on the results of detection by the detecting means, the selecting means selecting one of the at least one correction value depending on results of determination by the determining means.

According to this preferred embodiment, the number of choices of possible changes in the tone and loudness of the artificial sound is increased, which enables the player to make his or her performance even more colorful.

Further preferably, the waveform-forming means comprises a plurality of waveform-forming circuits for generating respective signals indicative of waveforms of the artificial sound, and the waveform-correcting means comprises a plurality of waveform-correcting circuits for correcting the signals output from the plurality of waveform-forming circuits, respectively. The electronic keyboard instrument includes an adder for adding up the signals indicative of the waveforms of the artificial sound, the signals having been output from the plurality of waveform-forming circuits after being corrected by the respective waveform-correcting circuits.

According to this preferred embodiment, the artificial sound is produced by adding up a plurality of tones having various rise-time and fall-time waveform portions, and hence enables to make the player to make his or her performance much more colorful.

Further preferably, the at least one operating element each comprises a pedal.

The above and other objects, features, and advantages of the invention will become more apparent from the ensuing detailed description taken in conjunction with the accompanying drawings.

DETAILED DESCRIPTION

The invention will now be described in detail with reference to drawings showing a preferred embodiment thereof.

Figure 1:
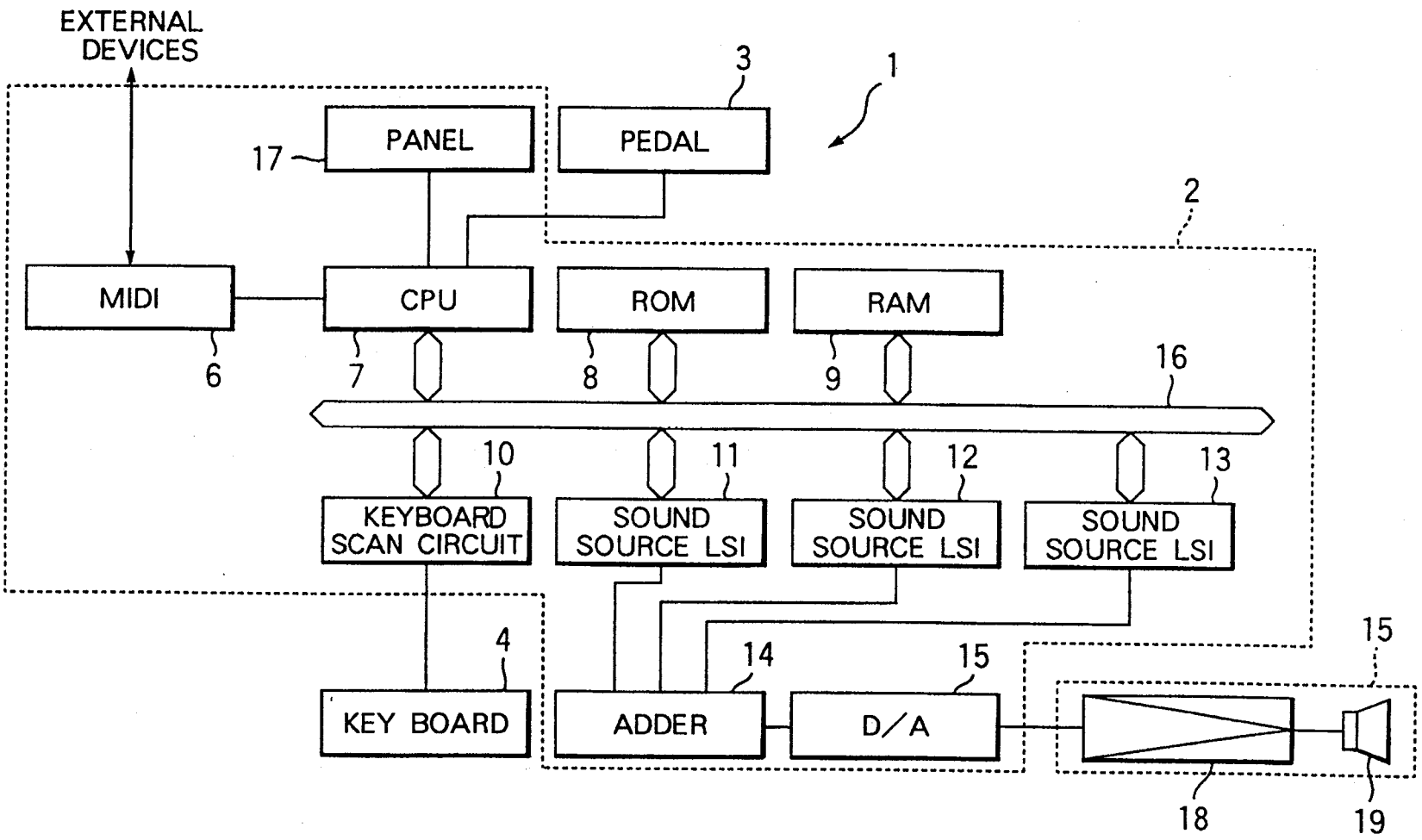
FIG. 1 is a block diagram showing an electronic keyboard instrument according to the invention.

Referring first to FIG. 1, there will be described an outline of construction of an electronic keyboard instrument according to an embodiment of the invention. Reference numeral 1 generally designates the electronic keyboard instrument, which comprises a control circuit 2, a pedal 3, a keyboard 4 having a plurality of keys, not shown, and a sound-producing block 5. The electronic keyboard instrument 1 operates such that when a key of the keyboard 4 is depressed, the control circuit 2 generates a digital signal indicative of an artificial sound corresponding to the depressed key. The control circuit 2 further converts tile digital signal into an analog signal. The resulting analog signal indicative of the artificial sound is amplified by the sound-producing block 5, and then output as tile artificial sound from a loudspeaker thereof. During this process, the control circuit 2 detects an ON status of the pedal in which it is being stepped on or an OFF status of same in which it is not being stepped on, and supplies the signal indicative of the artificial sound having a tone corresponding to the results of detection of tile ON/OFF status of the pedal to the sound-producing block 5.

Next, the construction of the electronic keyboard instrument 1 will be described in detail. The control circuit 2 comprises a Musical Instrument Digital Interface (hereinafter referred to as "MIDI") 6 connected to external devices, not shown, for transmitting MIDI signals to and receiving same from the external devices, a panel 17, a CPU 7 to which are connected tile MIDI 6, the panel 17, and the pedal 3 as an external element, a ROM 8, a RAM 9 for temporarily storing waveform data of an artificial sound, MIDI signals, data on the operating status of the control circuit 2, and the like, a keyboard scan circuit 10 for monitoring a key status, i.e. a key-on status or a key-off status of each key of the keyboard, sound source LSI's 11, 12, and 13 each for generating a digital signal indicative of an artificial sound under the control of the CPU 7, a bus line 16 connecting between the CPU 7, the ROM 8, the RAM 9, the keyboard scan circuit 10 and the sound source LSI's 11, 12, and 13, an adder 14 connected to the sound source LSI's 11, 12, and 13 for adding up the digital signals of the artificial sound output therefrom, and a digital-to-analog converter (hereinafter referred to as the "D/A converter") 15 connected to the adder 14 for converting the digital signal output therefrom into an analog signal. The MIDI 6 provides an interface for connecting the present electronic keyboard instrument 1 with other electronic musical instruments and a computer, if any, which is adapted to receive MIDI signals indicative of note ON/OFF information, pedal information on the status of a pedal, and the like, from the other electronic musical instruments, transmit those of the same kind of the present electronic keyboard instrument to the other electronic musical instruments, and receive and transmit MIDI signals on results of active sensing for detecting a disconnection of various wires connecting between devices of the instruments and computer associated with each other.

The CPU 7 controls operation of the electronic keyboard instrument 1. More specifically, it controls the overall operation of the electronic keyboard instrument 1, and operations of the sound source LSI's 11, 12, and 13 for generating digital signals of an artificial sound corresponding to a key depressed. It further detects an ON/OFF status of the pedal 3, corrects tile waveform of the artificial sound to be produced, based on a signal indicative of the ON/OFF status of tile pedal 3, controls communication with external devices, not shown, monitors a key status of each key of the keyboard, and so forth.

The ROM 8 stores data of control programs, a waveform address data table, tables of tone parameters, such as attack level, attack speed, and decay speed, a touch loudness data table, a waveform correction data table for a pedal-on state, and a waveform correction data table for a pedal-off state, all of which will be referred to hereinafter, data for settings of various sound effects, etc.

The sound source LSI's 11, 12, and 13 generate signals indicative of various artificial sounds and each have an identical construction. The number of sound source LSI's used according to the invention is not particularly limited, but in the present embodiment, the three LSI's are used far generating one artificial sound. That is, outputs therefrom are added up to thereby synthesize artificial tones having different waveforms into an artificial sound having a complicated waveform and being diversified in tone. In the following description, the operation of the sound source LSI 11 as a representative of the three LSI's will be described for explaining how a waveform of an artificial sound is formed.

The pedal 3 is operated to change a waveform of an artificial sound to be produced by the present instrument 1. When a player steps on the pedal 3, the sound source LSI's 11, 12, 13 are controlled to modify the waveform of the artificial sound to thereby change the tone and loudness of the artificial sound.

The keyboard 4 which has a plurality of keys, not specifically shown, arranged thereon, is for selecting an artificial sound to be produced by the present instrument 1. When a key is selectively depressed, an artificial sound corresponding thereto is produced by the present instrument. In this connection, a key number corresponding to the depressed key is supplied to the control circuit 2.

The panel 17 is means by which various settings for controlling the operation of the electronic keyboard instrument 1 are established by operating switches, knobs and the like, not shown, arranged thereon, to thereby allow the CPU 7 to read data thus defined on the settings. For example, the panel 17 allows a player to set-the present instrument for generating artificial rhythm sounds, as well as to set a loudness level of artificial sounds produced, sound effects, and so forth, and displays the settings thereon.

The sound-producing block 5 is comprised of an amplifier 18 for amplifying the analog signal indicative of the artificial sound supplied thereto from the control circuit 2, and a loudspeaker 19 connected to the amplifier 18 for producing the artificial sound.

Figure 2:
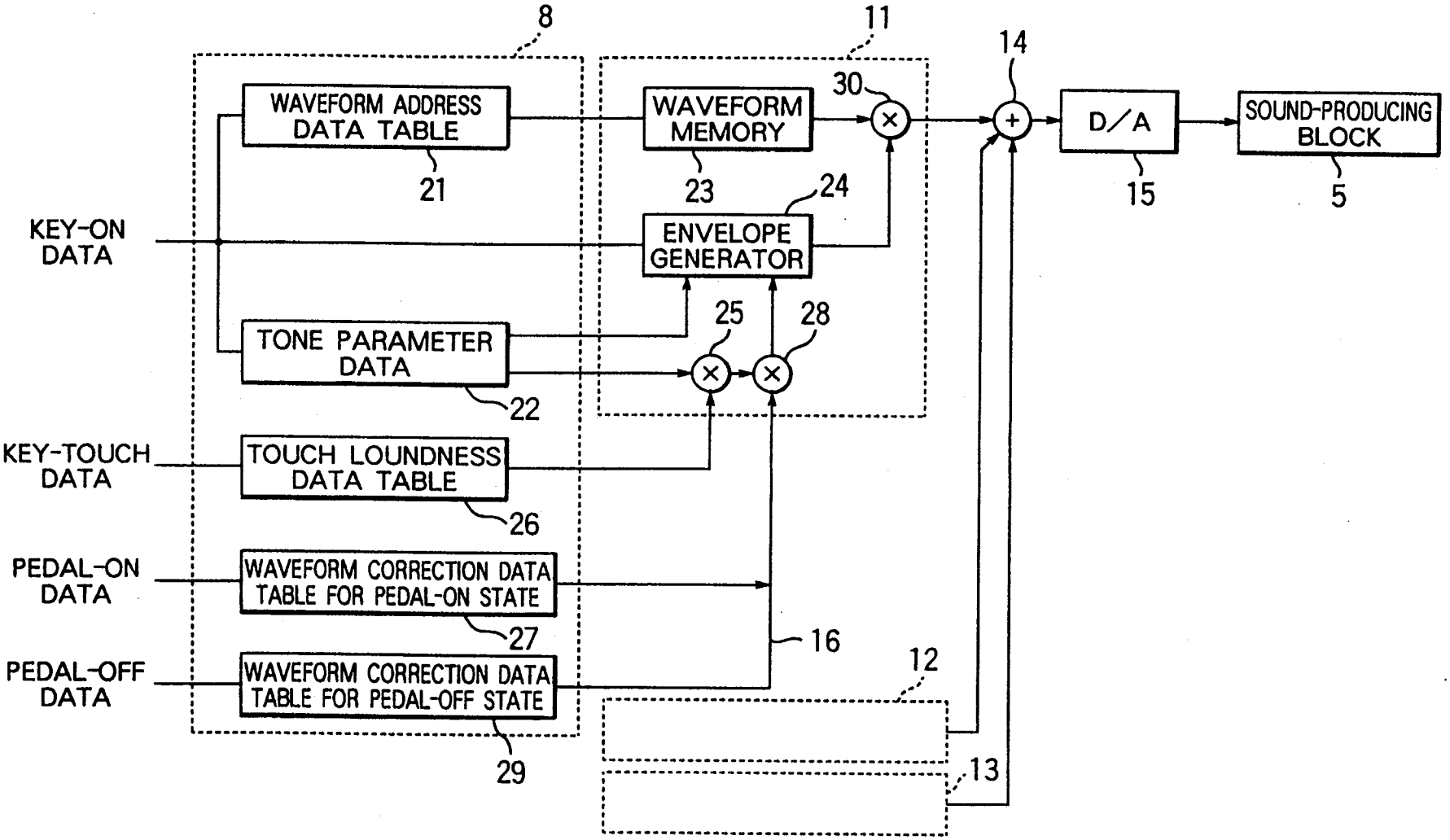
FIG. 2 is a block diagram which is useful in explaining how an artificial sound is generated by the electronic keyboard instrument according to the invention.
Figure 3:
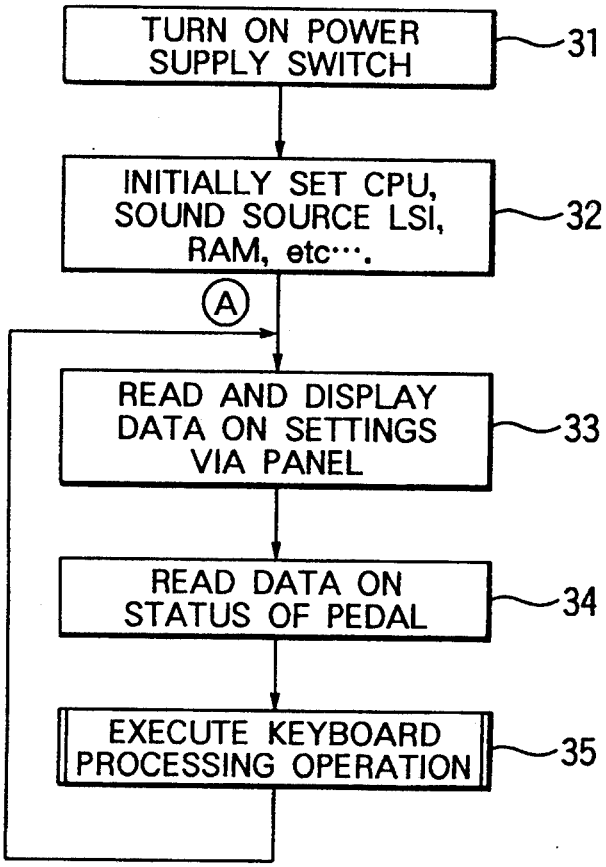
FIG. 3 is a flowchart showing the overall operation of the electronic keyboard instrument according to the invention.
Figure 4:
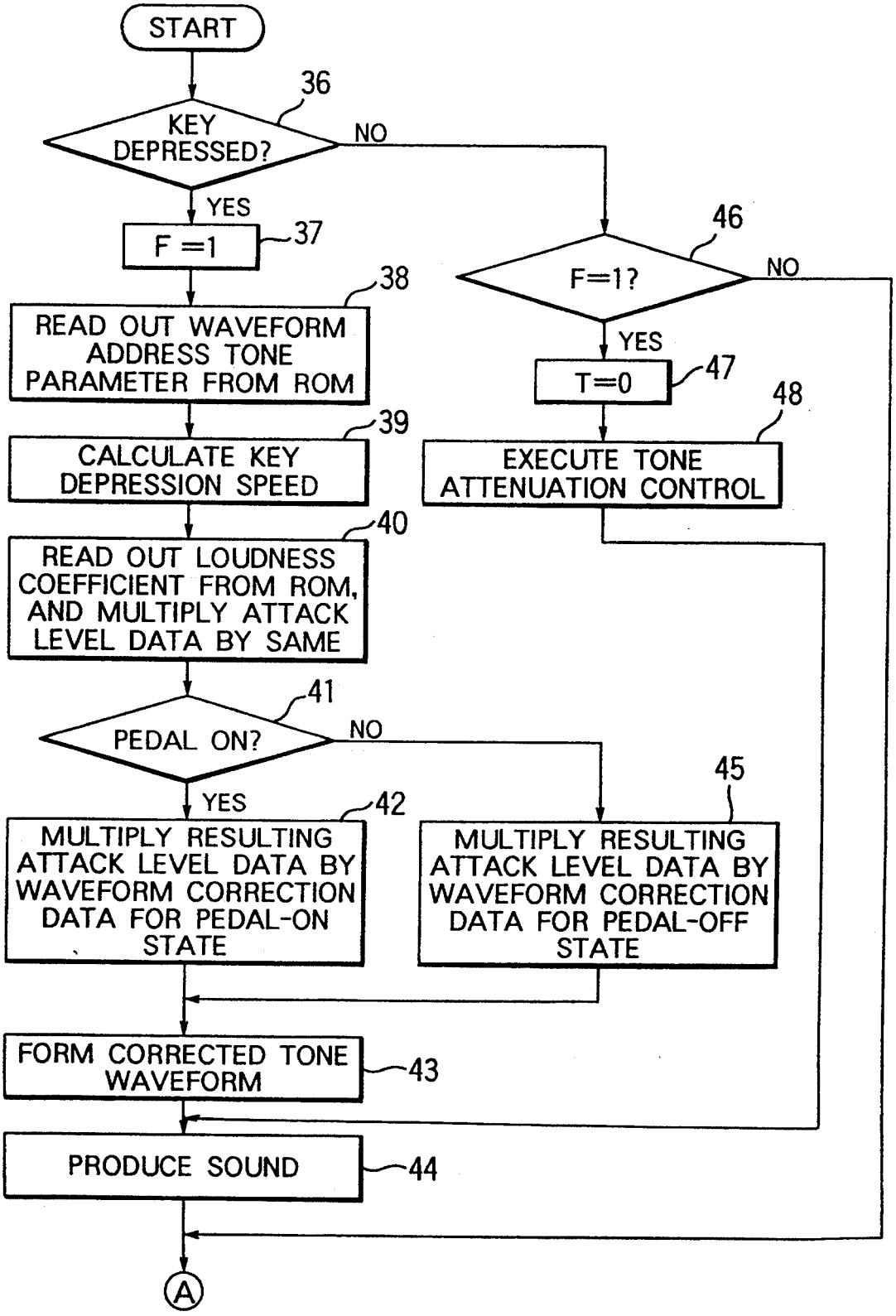
FIG. 4 is a flowchart showing details of a keyboard processing operation executed at one step of the FIG. 3 flowchart.

Next, the operation of the present electronic keyboard instrument 1 will be described with reference to FIG. 2, FIG. 3 and FIG. 4. FIG. 2 is a block diagram for explaining how an artificial sound is generated. FIG. 3 shows the overall flow of operation of the present electronic keyboard instrument 1, and FIG. 4 details of a keyboard processing operation executed at a step in the FIG. 3 program.

First, when a power supply switch, not shown, is turned on at a step 31, hardware, not shown, is started to initially set the CPU 7, the RAM 9, the sound source LSI's 11, 12, 13, etc. Then, according to a predetermined control program stored in the ROM 8, the CPU 7 sets a flag F for indication of a key-status of each key of a keyboard to a value of 0, and starts to execute the control of the electronic keyboard instrument in the following manner (step 32 ):

The CPU 7 reads the data on the above-mentioned settings established through the panel 17, in response to which signals are output from the CPU 7 to the panel 17 for displaying these settings thereon, and stores data of a kind of a rhythm sound to be generated, data of settings on the loudness level of artificial sounds, etc. into the RAM 9 (step 33). Then, the CPU 7 reads data on the status of the pedal 3, i.e. data as to whether or not the pedal 3 is being stepped on, and also stores the data into the RAM 9 (step 34).

Then, at the following step 35, a keyboard processing operation is executed. This operation is carried out according to a routine shown in FIG. 4. Referring to FIG. 4, first, the CPU 7 causes the keyboard scan circuit 10 to scan the statuses of all the keys by a predetermined repetition cycle of a fixed time period for monitoring whether any key is depressed, i.e. turned on, at a step 36. If a key is depressed, the CPU 7 sets the flag F to a value of 1 at a step 37, and then reads out waveform address data and tone parameter data from the waveform address data table 21 and the tone parameter data tables 22 stored in the ROM 8, respectively. Then, the CPU 7 supplies the waveform address data to a waveform memory 23 within each sound source LSI, and attack speed data and decay speed data of the tone parameters to an envelope parameter 24 within each sound source LSI. The attack level data of the tone parameters is supplied to one input terminal of a multiplier 25 within each sound source LSI (step 38). When no keys are depressed, it is determined at a step 46 whether or not the flag F has been set to a value of 1. If F=0, the keyboard processing operation is terminated.

Returning to the case where the key is depressed, the program proceeds from the step 38 to a step 39 to calculate a key depression speed of the depressed key. Each key is provided with two key depression-detecting switches, not shown, for detecting depression of the key at different points or depths of a key stroke thereof. The key depression speed is calculated from an interval between time points the two key depression-detecting switches detect depression of the key (step 39).

Then, the CPU 7 reads touch loudness data from the touch loudness data table stored in the ROM 8. The touch loudness data is a loudness coefficient for determining a loudness of the artificial sound in a manner corresponding to the key depression speed obtained at the step 39. The touch loudness data read out is supplied to a multiplier 25 of each of the sound source LSI's 11, 12, and 13, where it is multiplied by the attack level data supplied thereto at the step 38 (step 40). The product or resulting loudness coefficient multiplied by the attack level data is a control parameter which determines an attack level of the artificial sound produced from the electronic keyboard instrument 1. That is, by the use of this control parameter, the attack level, i.e. the maximum instantaneous value of loudness of the artificial sound, is increased in proportion to the key depression speed.

Then, the CPU 7 determines at a step 41 whether or not the pedal 3 is stepped on, from the data on the status of the pedal stored at the step 34.

If the pedal 3 is stepped on, the CPU 7 reads waveform correction data for the pedal-on state from the waveform correction data table 27 for the pedal-on state stored in the ROM 8, and supplies same to a multiplier 28 within each of the sound source LSI's 11, 12, and 13. At the multiplier 28, the product obtained by the multiplier 25 is multiplied by the waveform correction data for the pedal-on state (step 42). An output from the multiplier 28 is supplied to an envelope generator 24 within each of the sound source LSI's 11, 12, and 13.

The sound source LSi's 11, 12, 13 each operate based on the input data in the following manner:

First, the waveform memory 23 starts to generate pulses at predetermined frequencies corresponding to the waveform address data and having a predetermined voltage (hereinafter referred to as "the unit voltage"). The unit voltage corresponds to the maximum instantaneous value of amplitude of a signal indicative of the artificial sound supplied to the sound-producing block 5. The pulses having the unit voltage are synchronized by synchronizing means, not shown, to predetermined timing, and first, a first one thereof is supplied to a multiplier 30 within each sound source LSI.

Figure 5:
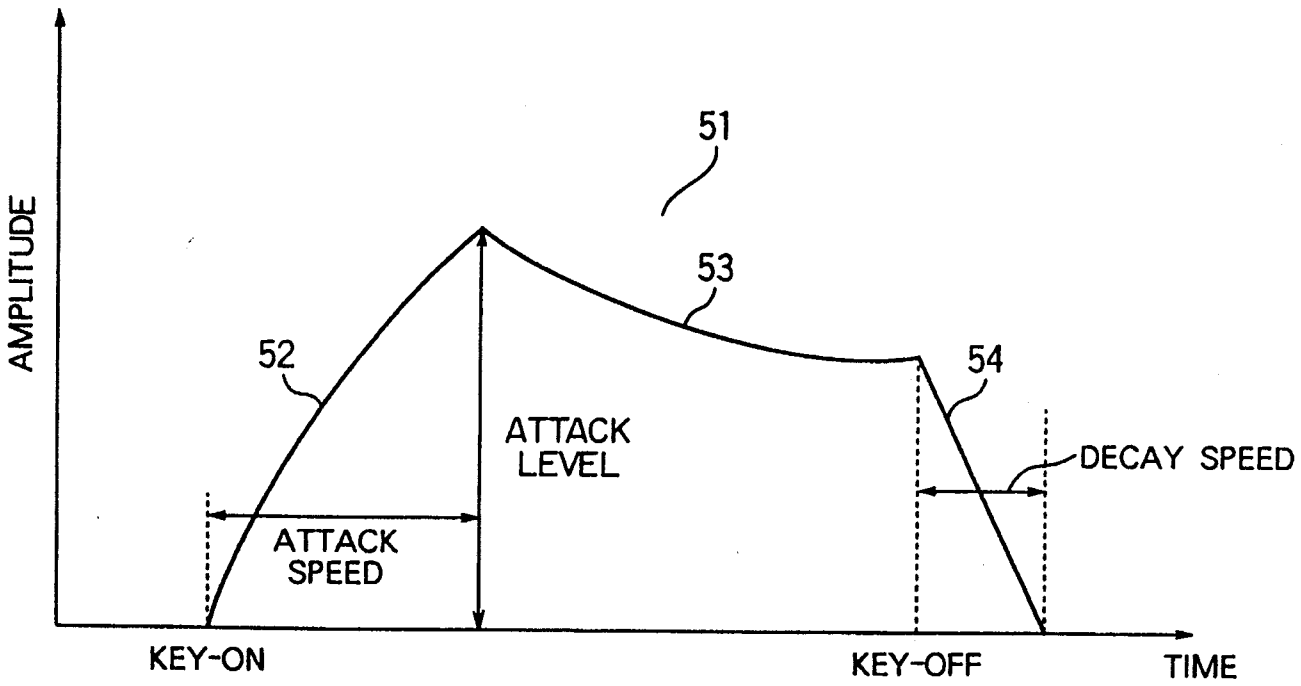
FIG. 5 is a diagram showing an example of a waveform of an artificial sound produced by the electronic keyboard instrument according to the invention.

Next, the multiplying operation by the multiplier 30 for forming a waveform of the artificial sound will be described with reference to FIG. 5. In FIG. 5, reference numeral 51 designates a simplified example of a waveform of an artificial sound produced by depressing one key on the keyboard, which is depicted from the start of generation of the artificial sound and the end of same. First, description will be made on how a rise-time portion 52 of the waveform is formed. The envelope generator 24 calculates a gradient of the rise-time portion 52 of the waveform from the attack speed data and the product obtained by the multiplier 28 to thereby determine an envelope of the rise-time portion 52 of the waveform of the artificial sound. Then, an amplitude value of a portion of the thus determined rise-time portion 52 of the waveform corresponding to the first pulse having the unit voltage output from the waveform memory is supplied, through synchronization by the aforementioned synchronizing means, not shown, to the multiplier 30 at the same timing as the first pulse. In this connection, the amplitude value is a coefficient which is represented by a ratio relative to the unit voltage, and has the maximum value of 1.

The multiplier 30 multiplies the unit voltage by the amplitude value to thereby produce the portion of the waveform of the artificial sound corresponding to the first pulse. The multiplier 30 supplies the first pulse for forming the waveform of the artificial sound to the adder 14. The operation described above is similarly carried out by the other sound source LSI's 12 and 13. Thereafter, the following pulses for forming the waveform of the artificial sound are sequentially produced, and supplied, under synchronizing control by the aforementioned synchronizing means, to the adder 14. Thus, there is formed the rise-time portion 52 of the waveform of the artificial sound from the instant of detection of the key-on status to a time point the attack level is reached (step 43).

Then, the CPU 7 forms a portion of the waveform from the attainment of the attack level to a time point the key-off status is detected in the following manner: In each sound source LSI, the envelope generator 24 calculates amplitude values for this portion of the waveform based on the attack level such that the waveform of the artificial sound has a predetermined envelope portion 53 from the time point the attack level is reached and the time point the key-off status is detected, as shown in FIG. 5, and similarly to generation of the rise-time portion of the wave-form, the amplitude values are sequentially supplied to the multiplier 30 together with output pulses from the waveform memory 23. The multiplier 30 operates similarly to the above-described case of generation of the rise-time portion 52. Outputs from the sound source LSI's 11, 12, 13 are supplied to the adder 14, to thereby form an envelope portion 53 of the waveform of the artificial sound (step 43).

On the other hand, if it is determined at the step 41 that the pedal 3 is not stepped on, the CPU 7 reads out waveform correction data for the pedal-off state from the waveform correction data table for the pedal-off state stored in the ROM 8, and supplies same to each multiplier 28 of the sound source LSI's 11, 12, and 13 (step 45), and operations similar to those carried out in the pedal-on state are carried out to produce a signal indicative of a waveform of the artificial sound (step 43).

Further, if it is determined at the step 36 that the key is not depressed, the CPU 7 determines at a step 46 whether or not the flag F has been set to a value of 1. If the flag F=1, the flag F is set to a value of 0 at a step 47, and then executes the tone attenuation control (step 48) in the following manner: The envelope generator 24 calculates a gradient of a fall-time portion 54 of the waveform from the amplitude value assumed at the detection of the key-off status and the decay speed data of the tone parameter data, to thereby determine an envelope of the fall-time portion 54 of the waveform. Then, similarly to the rise-time portion 52, the multiplier 30 multiplies a sequence of outputs from the waveform memory 23, i.e. a sequence of pulses having predetermined frequencies and the unit voltage, by respective amplitude values sequentially output from the envelope generator 24 corresponding there-to, to thereby form a fall-time portion 54 of the waveform of the artificial sound from the detection of the key-off status, to the stoppage of production of sound (step 48).

The adder 14 adds up digital signals indicative of tones having different waveforms which are output from the sound source LSI's 11, 12, 13, and then supplies the resulting sum to the D/A converter 15. The D/A converter 15 converts the digital signal from the adder 14 into an analog signal to supply the resulting analog signal to the amplifier 18 of the sound-producing block 5. The amplifier 18 amplifies the analog signal indicative of the artificial sound such that the artificial sound has a predetermined volume set by way of the panel 17, and then supplies the amplified signal to the loudspeaker 19, from which the artificial sound is produced (step 44).

This completes the keyboard processing operation for generating the waveform of the artificial sound, and thereafter, the step 33 et seq. in FIG. 3 are repeatedly carried out.

In addition, at the step 41, the CPU 7 carries out determination only on whether or not the pedal 3 is stepped on. This is not limitative, but there may be provided another waveform correction table to be selected when another pedal is detected to be stepped on, and means for determining which pedal is stepped on, whereby when the pedal other than the pedal 3, e.g. a sostenuto pedal, is stepped on, waveform correction data corresponding to the on-status of the sostenuto pedal is read out from a wave-form correction data table therefor to thereby form a waveform of an artificial sound.

As described heretofore, according to the present embodiment, the loudness coefficient after multiplication by the attack level data is multiplied by the multiplier 28, by different waveform correction data depending on whether or not the pedal 3 is stepped on, which accordingly varies the attack level and envelope of an artificial sound to be produced, to change the waveform of the artificial sound. Thus, the tone of the artificial sound can be changed by operating the pedal 3, to enable a player to make his or her performance more colorful. Further, the artificial sound can be produced such that the attack level is proportional to the key depression speed, which makes it possible to make the player's performance even more colorful. Further, the use of a plurality of sound source LSI's results in formation of a waveform of an artificial sound obtained by adding up a plurality of artificial tones different in rise-time and fall-time waveform portions, which enables the player to give much more colorful performance.

Although, in the present embodiment, three sound source LSI's are used, this is not limitative, but the number thereof can be determined as desired. Further, al though in the present embodiment, depending on whether the pedal 3 is stepped on, the attack level of the artificial sound is changed, this is not limitative, but the contents of the waveform correction data table for the pedal-on state may be changed as desired, e.g. such that either or both of a rise-time portion and a fall-time portion of a waveform of an artificial sound be modified to an exponential function waveform, a stepped waveform, etc. Similarly, the shape of an envelope portion from attainment of the attack level to detection of the key-off state can be set as desired. Further, by changing contents of the waveform correction data table, the attack speed and the decay speed may be changed. Further, al though in the present embodiment, the waveform correction data for the pedal-on state is used by the multiplier, this is not limitative, but the data may be used by an adder.

Further, al though in the above embodiment, description has been made of a case where one loudspeaker is used, this is not limitative, but there may be provided two or more sound source LSI's and a corresponding number of loudspeakers, to thereby produce a stereophonic sound. Further, it is to be understood that variations and modifications may be made to details of construction of the electronic keyboard instrument according to the present invention and a manner of control thereof without departing the scope of the present invention.

What is claimed is:

1. An electronic keyboard instrument for producing an artificial sound, comprising:

a plurality of keys;

original sound signal generating means for generating an original sound signal of said artificial sound corresponding to each of said keys;

waveform data storing means for storing an attack time and a release time of said artificial sound corresponding to each of said keys;

key depression speed detecting means for detecting a key depression speed of each of said keys;

loudness coefficient storing means for storing a plurality of loudness coefficients;

at least one pedal;

pedal operation detecting means for detecting whether or not said at least one pedal is being operated;

loudness change coefficient storing means for storing a plurality of loudness change coefficients;

reading means for, when one of said keys is depressed, reading said attack time and said release time corresponding to said depressed key from said waveform data storing means, and said loudness coefficient from said loudness coefficient storing means depending on said key depression speed detected by said key depression speed detecting means;

calculating means for calculating an amplitude value of said artificial sound based on said attack time, said release time and said loudness coefficient read by said reading means;

artificial sound signal producing means for producing an artificial sound signal by multiplying said original sound signal by said amplitude value; and waveform modification means for modifying a waveform of said artificial sound signal by reading said loudness change coefficient from said loudness change coefficient storing means depending on detection results of said pedal operation detecting means, and by changing said loudness coefficient based on said read loudness change coefficient.

2. An electronic keyboard instrument according to claim 1, wherein said waveform modification means changes said loudness coefficient by multiplying said loudness coefficient by said loudness change coefficient.

3. An electronic keyboard instrument according to claim 1, wherein said waveform modification means changes said loudness coefficient by adding said loudness change coefficient to said loudness coefficient.

4. An electronic keyboard instrument according to claim 1, wherein said waveform modification means determines an attack level of said waveform of said artificial sound signal based on said attack time, said loudness coefficient and said loudness change coefficient.

5. An electronic keyboard instrument according to claim 2, wherein said waveform modification means determines an attack level of said waveform of said artificial sound signal based on said attack time, said loudness coefficient and said loudness change coefficient.

6. An electronic keyboard instrument according to claim 3, wherein said waveform modification means determines an attack level of said waveform of said artificial sound signal based on said attack time, said loudness coefficient and said loudness change coefficient.

7. An electronic keyboard instrument according to claim 1, wherein said loudness change coefficient storing means stores at least one loudness change coefficient, and wherein said waveform modification means includes selecting means for selecting one of said at least one loudness change coefficient depending on detection results of said pedal operation detecting means.

8. An electronic keyboard instrument according to claim 2, wherein said loudness change coefficient storing means stores at least one loudness change coefficient, and wherein said waveform modification means includes selecting means for selecting one of said at least one loudness change coefficient depending on detection results of said pedal operation detecting means.

9. An electronic keyboard instrument according to claim 3, wherein said loudness change coefficient storing means stores at least one loudness change coefficient, and wherein said waveform modification means includes selecting means for selecting one of said at least one loudness change coefficient depending on detection results of said pedal operation detecting means.

10. An electronic keyboard instrument according to claim 4, wherein said loudness change coefficient storing means stores at least one loudness change coefficient, and wherein said waveform modification means includes selecting means for selecting one of said at least one loudness change coefficient depending on detection results of said pedal operation detecting means.

11. An electronic keyboard instrument according to claim 1, wherein said at least one pedal consists of a single pedal, and wherein said loudness change coefficient storing means stores two loudness change coefficients, and wherein said waveform modification means includes selecting means for selecting one of said two loudness change coefficients depending on detection results of said pedal operation detecting means.

12. An electronic keyboard instrument according to claim 2, wherein said at least one pedal consists of a single pedal, and wherein said loudness change coefficient storing means stores two loudness change coefficients, and wherein said waveform modification means includes selecting means for selecting one of said two loudness change coefficients depending on detection results of said pedal operation detecting means.

13. An electronic keyboard instrument according to claim 3, wherein said at least one pedal consists of a single pedal, and wherein said loudness change coefficient storing means stores two loudness change coefficients, and wherein said waveform modification means includes selecting means for selecting one of said two loudness change coefficients depending on detection results of said pedal operation detecting means.

14. An electronic keyboard instrument according to claim 4, wherein said at least one pedal consists of a single pedal, and wherein said loudness change coefficient storing means stores two loudness change coefficients, and wherein said waveform modification means includes selecting means for selecting one of said two loudness change coefficients depending on detection results of said pedal operation detecting means.

15. An electronic keyboard instrument according to claim 7, wherein said at least one pedal consists of a single pedal, and wherein said loudness change coefficient storing means stores two loudness change coefficients, and wherein said waveform modification means includes selecting means for selecting one of said two loudness change coefficients depending on detection results of said pedal operation detecting means.

16. An electronic keyboard instrument according to claim 7, wherein said at least one pedal consists of a plurality of pedals, and wherein said waveform modification means includes determining means for determining which of said plurality of pedals is being operated based on said detection results by said pedal operation detecting means, and wherein said selecting means selects one of said at least one loudness change coefficient depending on determination results by said determining means.

* * * * *